US005857955A

United States Patent [19]

Phillips et al.

[11] Patent Number: 5,857,955

[45] Date of Patent: Jan. 12, 1999

[54] CENTRIFUGE CONTROL SYSTEM

[75] Inventors: Victor Phillips, Oklahoma City; Che-Liang Chang, Edmond; Troy Martin, Oklahoma City, all of Okla.

[73] Assignee: M-I Drilling Fluids L.L.C., Houston, Tex.

[21] Appl. No.: 622,417

[22] Filed: Mar. 27, 1996

[51] Int. Cl.[6] ..... B04B 9/10; B04B 13/00

[52] U.S. Cl. ..... 494/5; 494/8; 494/9; 494/82; 494/84

[58] Field of Search ..... 494/1, 5, 7–10, 494/12, 27, 30, 42, 52–54, 82–84; 210/97, 103, 134, 143, 144, 380.3

[56] References Cited

U.S. PATENT DOCUMENTS

| | | | |
|---|---|---|---|
| 2,867,378 | 1/1959 | Harlow . | |
| 3,228,594 | 1/1966 | Amero | 494/53 X |
| 3,494,542 | 2/1970 | Craig et al. | 494/7 |
| 3,532,264 | 10/1970 | Amero . | |
| 4,070,290 | 1/1978 | Crosby | 494/8 X |
| 4,129,249 | 12/1978 | Todd . | |
| 4,141,488 | 2/1979 | Gense . | |
| 4,228,949 | 10/1980 | Jackson | 494/84 X |
| 4,240,578 | 12/1980 | Jackson | 494/1 X |
| 4,299,353 | 11/1981 | Bruning et al. | 494/8 |
| 4,303,192 | 12/1981 | Katsume . | |
| 4,327,862 | 5/1982 | Jakobs . | |
| 4,334,647 | 6/1982 | Taylor . | |
| 4,344,976 | 8/1982 | Bladh . | |
| 4,369,915 | 1/1983 | Oberg et al. . | |
| 4,411,646 | 10/1983 | Cyphelly . | |
| 4,421,502 | 12/1983 | Jakobs | 494/7 |
| 4,432,747 | 2/1984 | Posse et al. | 494/9 X |
| 4,643,709 | 2/1987 | Lee et al. . | |
| 4,668,213 | 5/1987 | Kramer | 494/9 |
| 4,720,776 | 1/1988 | Guyeska et al. . | |
| 4,749,486 | 6/1988 | Yaoxin et al. . | |
| 4,978,331 | 12/1990 | Luchetta et al. . | |
| 5,203,762 | 4/1993 | Cooperstein . | |
| 5,217,428 | 6/1993 | Schlip et al. . | |
| 5,244,451 | 9/1993 | Retter . | |
| 5,403,260 | 4/1995 | Hensley | 494/8 |
| 5,484,521 | 1/1996 | Kramer . | |
| 5,529,566 | 6/1996 | Weil . | |
| 5,681,256 | 10/1997 | Nagafuji | 494/9 |

FOREIGN PATENT DOCUMENTS

| | | | |
|---|---|---|---|
| 2358803 | 6/1975 | Germany | 494/7 |
| 2709569 | 10/1977 | Germany | 494/7 |
| 2819399 | 11/1978 | Germany | 494/8 |
| 3005658 | 10/1981 | Germany | 494/8 |
| 53-91465 | 8/1978 | Japan | 494/5 |
| 58-205554 | 11/1983 | Japan . | |
| 62-168560 A | 7/1987 | Japan . | |
| 63-116762 | 5/1988 | Japan | 494/7 |
| 2099334 | 12/1982 | United Kingdom | 494/53 |

OTHER PUBLICATIONS

Osamu Matsumoto, Takehiko Tashamatsu, and Kasuo Kajiya, "Application of an Inverter Drive to a Machine for Foods," *Automation: Actual Magazine for Measurement, Control, and Automation System*, vol. 34, No. 2, 1989, pp. 70–78, 108.

*Primary Examiner*—Charles E. Cooley
*Attorney, Agent, or Firm*—Haynes and Boone, L.L.P.

[57] ABSTRACT

A system, method and computer program for controlling a centrifuge which receives a mixture of liquid and solid particles and separates the liquid from the solid particles. A bowl, along with a conveyor extending inside the bowl, are rotated at different speeds and the speed of, and the torque applied to, the bowl and the conveyor are detected and corresponding output signals are generated. A meter is provided for metering the flow of the mixture to the centrifuge and generating corresponding output signals. A computer responds to instructions from computer programs and controls the speed of the bowl and the conveyor as well as the flow of the mixture and a diluting agent to the centrifuge in response to the output signals in a manner to attain predetermined predetermined optimum operating conditions of the centrifuge.

9 Claims, 10 Drawing Sheets

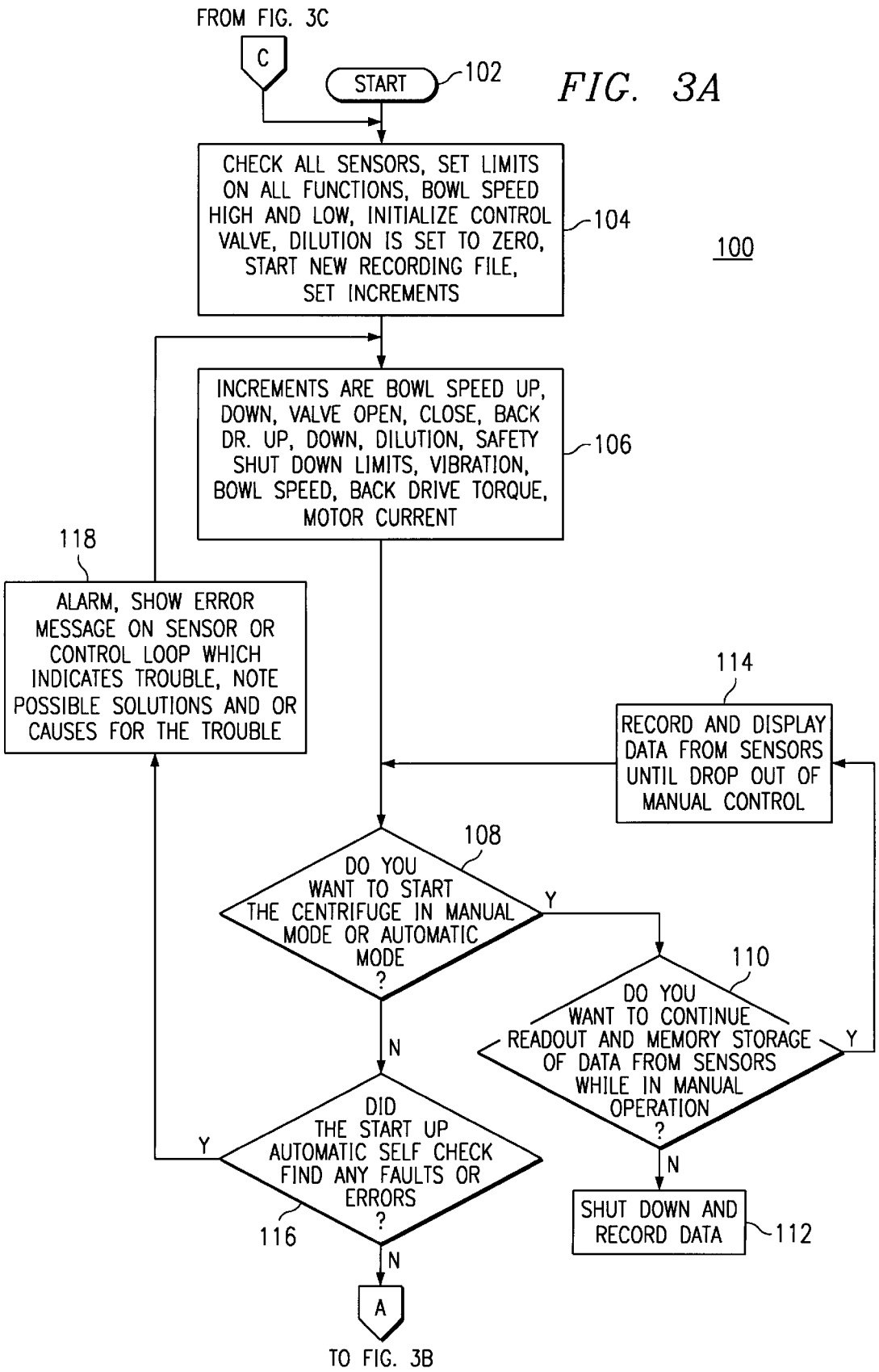
FROM FIG. 3C
C
START
102
FIG. 3A
CHECK ALL SENSORS, SET LIMITS ON ALL FUNCTIONS, BOWL SPEED HIGH AND LOW, INITIALIZE CONTROL VALVE, DILUTION IS SET TO ZERO, START NEW RECORDING FILE, SET INCREMENTS
104
100
INCREMENTS ARE BOWL SPEED UP, DOWN, VALVE OPEN, CLOSE, BACK DR. UP, DOWN, DILUTION, SAFETY SHUT DOWN LIMITS, VIBRATION, BOWL SPEED, BACK DRIVE TORQUE, MOTOR CURRENT
106
118
ALARM, SHOW ERROR MESSAGE ON SENSOR OR CONTROL LOOP WHICH INDICATES TROUBLE, NOTE POSSIBLE SOLUTIONS AND OR CAUSES FOR THE TROUBLE
114
RECORD AND DISPLAY DATA FROM SENSORS UNTIL DROP OUT OF MANUAL CONTROL
108
DO YOU WANT TO START THE CENTRIFUGE IN MANUAL MODE OR AUTOMATIC MODE ?
Y
110
DO YOU WANT TO CONTINUE READOUT AND MEMORY STORAGE OF DATA FROM SENSORS WHILE IN MANUAL OPERATION ?
Y
N
DID THE START UP AUTOMATIC SELF CHECK FIND ANY FAULTS OR ERRORS ?
Y
116
N
SHUT DOWN AND RECORD DATA
112
A
TO FIG. 3B

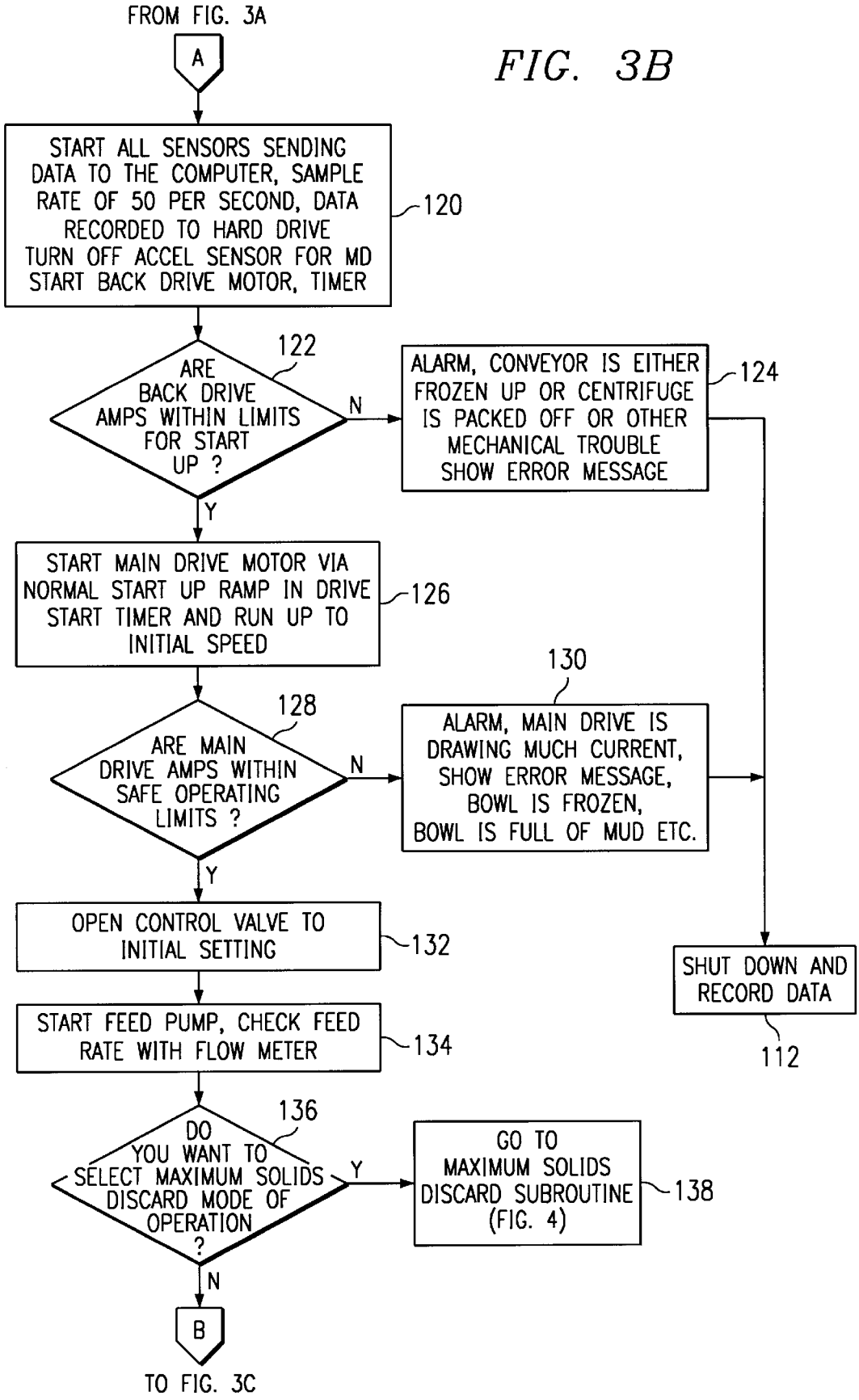
FROM FIG. 3A
A
FIG. 3B
START ALL SENSORS SENDING DATA TO THE COMPUTER, SAMPLE RATE OF 50 PER SECOND, DATA RECORDED TO HARD DRIVE TURN OFF ACCEL SENSOR FOR MD START BACK DRIVE MOTOR, TIMER
120
122
ARE BACK DRIVE AMPS WITHIN LIMITS FOR START UP ?
N
ALARM, CONVEYOR IS EITHER FROZEN UP OR CENTRIFUGE IS PACKED OFF OR OTHER MECHANICAL TROUBLE SHOW ERROR MESSAGE
124
Y
START MAIN DRIVE MOTOR VIA NORMAL START UP RAMP IN DRIVE START TIMER AND RUN UP TO INITIAL SPEED
126
130
128
ARE MAIN DRIVE AMPS WITHIN SAFE OPERATING LIMITS ?
N
ALARM, MAIN DRIVE IS DRAWING MUCH CURRENT, SHOW ERROR MESSAGE, BOWL IS FROZEN, BOWL IS FULL OF MUD ETC.
Y
OPEN CONTROL VALVE TO INITIAL SETTING
132
SHUT DOWN AND RECORD DATA
112
START FEED PUMP, CHECK FEED RATE WITH FLOW METER
134
136
DO YOU WANT TO SELECT MAXIMUM SOLIDS DISCARD MODE OF OPERATION ?
Y
GO TO MAXIMUM SOLIDS DISCARD SUBROUTINE (FIG. 4)
138
N
B
TO FIG. 3C

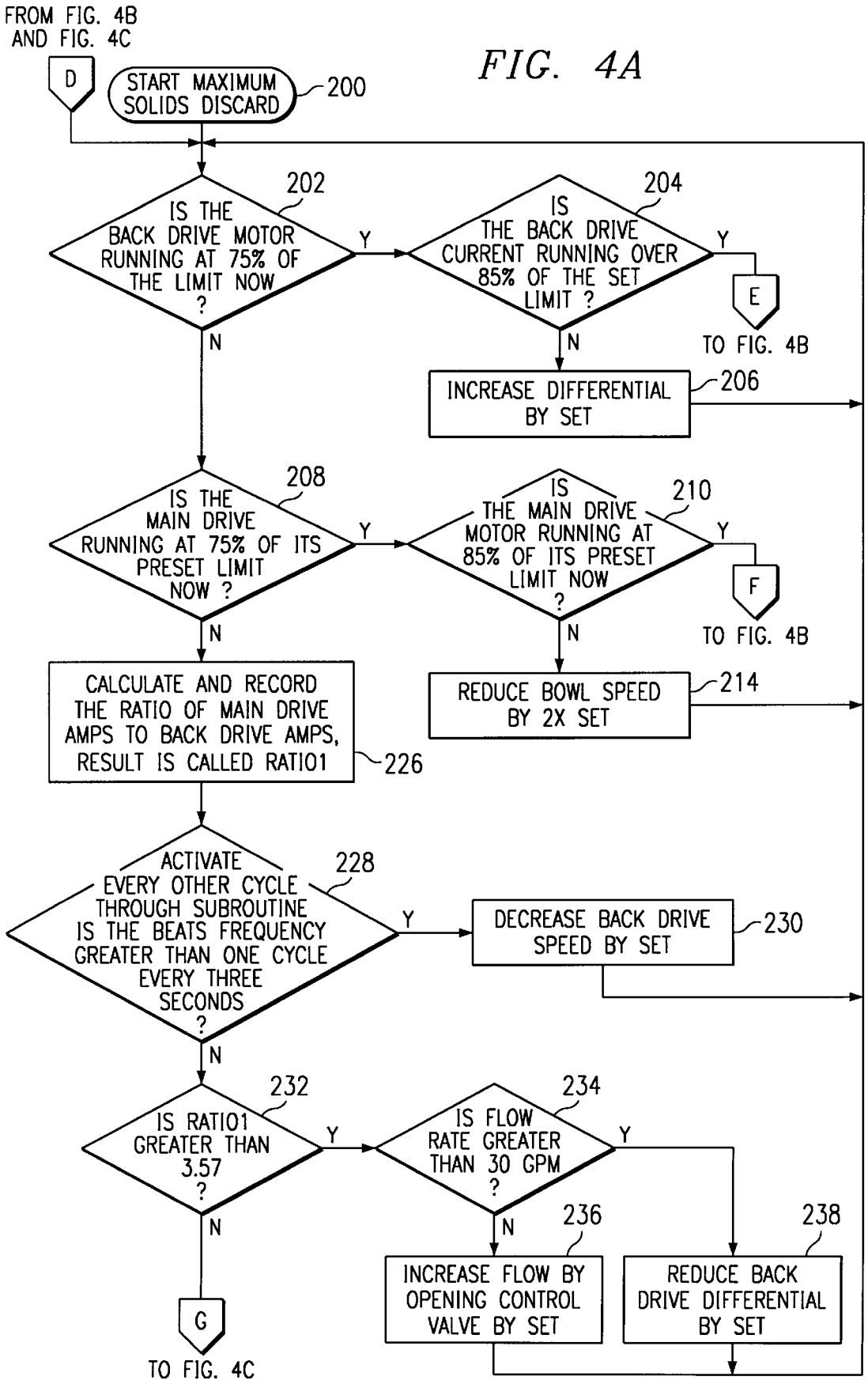
FROM FIG. 4B AND FIG. 4C
D
START MAXIMUM SOLIDS DISCARD
200
FIG. 4A
IS THE BACK DRIVE MOTOR RUNNING AT 75% OF THE LIMIT NOW ?
202
Y
N
IS THE BACK DRIVE CURRENT RUNNING OVER 85% OF THE SET LIMIT ?
204
Y
N
E
TO FIG. 4B
INCREASE DIFFERENTIAL BY SET
206
IS THE MAIN DRIVE RUNNING AT 75% OF ITS PRESET LIMIT NOW ?
208
Y
N
IS THE MAIN DRIVE MOTOR RUNNING AT 85% OF ITS PRESET LIMIT NOW ?
210
Y
N
F
TO FIG. 4B
REDUCE BOWL SPEED BY 2X SET
214
CALCULATE AND RECORD THE RATIO OF MAIN DRIVE AMPS TO BACK DRIVE AMPS, RESULT IS CALLED RATIO1
226
ACTIVATE EVERY OTHER CYCLE THROUGH SUBROUTINE IS THE BEATS FREQUENCY GREATER THAN ONE CYCLE EVERY THREE SECONDS ?
228
Y
N
DECREASE BACK DRIVE SPEED BY SET
230
IS RATIO1 GREATER THAN 3.57 ?
232
Y
N
IS FLOW RATE GREATER THAN 30 GPM ?
234
Y
N
INCREASE FLOW BY OPENING CONTROL VALVE BY SET
236
REDUCE BACK DRIVE DIFFERENTIAL BY SET
238
G
TO FIG. 4C

FROM FIG. 4A
G

240
IS RATIO1 GREATER THAN 2.15 ?
Y
N
INCREASE FLOW BY 3X SET
242
248
IS MAIN DRIVE LESS THAN 65% OF LIMIT ?
Y
N
254
IS FLOW RATE GREATER THAN 85% OF LIMIT ?
Y
N
250
INCREASE BOWL SPEED BY SET
252
INCREASE FLOW BY 2X SET
256
INCREASE FLOW BY 3X SET
258
INCREASE BOWL SPEED BY SET
244
DO YOU WANT TO CHANGE THE SETS OR LIMITS ON THE FLY ?
N
Y
RESET SETS AND LIMITS
246
D
TO FIG. 4A

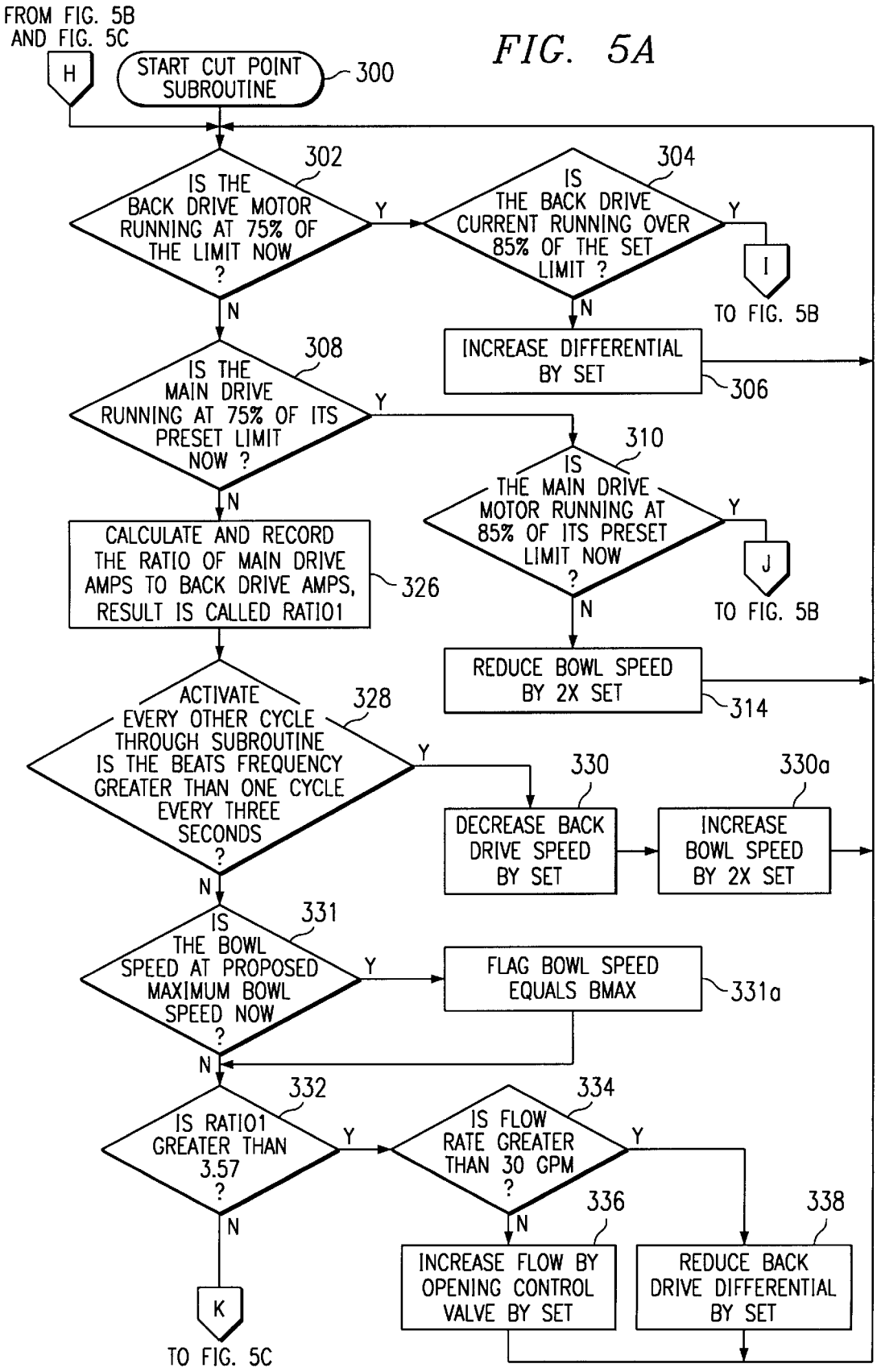
FROM FIG. 5B AND FIG. 5C
H
START CUT POINT SUBROUTINE
300
FIG. 5A
302
IS THE BACK DRIVE MOTOR RUNNING AT 75% OF THE LIMIT NOW ?
Y
N
304
IS THE BACK DRIVE CURRENT RUNNING OVER 85% OF THE SET LIMIT ?
Y
N
I
TO FIG. 5B
INCREASE DIFFERENTIAL BY SET
306
308
IS THE MAIN DRIVE RUNNING AT 75% OF ITS PRESET LIMIT NOW ?
Y
N
310
IS THE MAIN DRIVE MOTOR RUNNING AT 85% OF ITS PRESET LIMIT NOW ?
Y
N
J
TO FIG. 5B
CALCULATE AND RECORD THE RATIO OF MAIN DRIVE AMPS TO BACK DRIVE AMPS, RESULT IS CALLED RATIO1
326
REDUCE BOWL SPEED BY 2X SET
314
328
ACTIVATE EVERY OTHER CYCLE THROUGH SUBROUTINE IS THE BEATS FREQUENCY GREATER THAN ONE CYCLE EVERY THREE SECONDS ?
Y
N
330
DECREASE BACK DRIVE SPEED BY SET
330a
INCREASE BOWL SPEED BY 2X SET
331
IS THE BOWL SPEED AT PROPOSED MAXIMUM BOWL SPEED NOW ?
Y
N
FLAG BOWL SPEED EQUALS BMAX
331a
332
IS RATIO1 GREATER THAN 3.57 ?
Y
N
334
IS FLOW RATE GREATER THAN 30 GPM ?
Y
N
336
INCREASE FLOW BY OPENING CONTROL VALVE BY SET
338
REDUCE BACK DRIVE DIFFERENTIAL BY SET
K
TO FIG. 5C

CENTRIFUGE CONTROL SYSTEM

BACKGROUND OF THE INVENTION

The present invention relates to a centrifuge control system and method and, more particularly, to a control system and method for controlling the operation of a decanting centrifugal separator in response to variations in several operating parameters.

Decanting centrifuges are well known in the art and are designed to process a mixture of two constituents, usually a liquid and a solid, separating one from the other. These types of centrifuges feature a rotating bowl and a spiral screw conveyer disposed inside the bowl which rotates in the same direction as the bowl and at a different speed. The mixture, which for the purpose of example, will be assumed to be a liquid having relative fine solid particles entrained therein, enters the bowl and the centrifugal forces direct and hold it against the inner wall of the bowl in a "pool" while the fluid is displaced to one end portion of the bowl for discharge. The solid particles settle against the wall and are transported, or displaced, by the screw conveyor to discharge ports extending through the opposite end portion of the bowl for discharge. Typical applications of this type of centrifuge is in pulp, paper, and waste water treatments and for the removal of dirt, sand, shale, abrasive cuttings, and/or silt particles (hereinafter referred to as "solid particles") from drilling fluid after the fluid has been circulated through a drilling bit to lift the cuttings to the surface in an oil field drilling operation.

However, there are several parameters involved in the operation of a centrifuge, such as bowl speed and torque, conveyor speed and torque, fluid pump rate, fluid viscosity or dilution, and fluid solids content and properties. Since the operational goals of the centrifuge itself are fairly precise, it is important that the centrifuge be controlled so that its operation is optimized in response to variations in the above parameters. Also, the centrifuge itself can be operated in different modes in accordance with different design goals, such as maximum solids separation, maximum solids discard volume, etc., which requires further precise control. Therefore, what is needed is a control system of the above type which can maintain precise predetermined operational modes despite variations in the various operational parameters and design goals and which includes computer programs stored on computer-readable media that can be utilized to achieve these goals.

Also, in critical field operations utilizing the centrifuge, a sudden shutdown of the centrifuge due to breakage, mechanical failure, etc. can be disastrous. Therefore, what is needed in this respect is a control system of the above type which predicts eminent mechanical failure, modifies the operation of the centrifuge, and provides an advanced warning so that failure of the centrifuge can be minimized.

SUMMARY OF THE INVENTION

The present invention, accordingly, provides a system, a method and a series of computer programs for controlling a centrifuge in which various signals corresponding to related parameters are processed, and the operation of the centrifuge variables are adjusted as necessary to maintain optimum performance in accordance with particular design goals. Also, certain components in the system are monitored for signatures which predict excessive wear and/or potential failure, and a corresponding warning signal is generated while certain parameters are adjusted to delay or avoid the failure.

To this end, the control system of the present invention includes a computer program stored on a media which can be read by a computer having several inputs which receive signals from various components associated with the centrifuge including sensors that monitor its operation. The computer processes these signals and the program contains instructions which enables the computer to control the drive units for the centrifuge bowl and conveyor, the flow of the mixture and a diluting agent to the centrifuge, and the introduction of a dilution agent into the mixture to achieve predetermined optimum operating conditions, all according to predetermined operational goals of the centrifuge.

The above-mentioned sensors include one or more accelerometers that provide data that enables the predetermined operating conditions to be attained in a relative quick manner. Also, the computer program contains instructions that enables the computer to process information received from the accelerometers in a manner to detect any adverse anomalies with respect to the rotating members and to generate corresponding output signals to correct the anomalies and signal the possibility of a potential malfunction.

As a result, major advantages are achieved with the system and method of the present invention since the operation of the centrifuge can remain optimized despite variations in the operational parameters and despite changes in the design goals of the centrifuge.

Another major advantage is achieved with the system and method of the present invention since the computer program can be designed to predict failure of one or more components of the system and generate an early, fail safe, warning signal while taking corrective measures to minimize the amount of shut-down time and degree of destruction. Also, the computer may alter operational rates or speeds in order to postpone the predicted mechanical failure until service personnel are available to make needed repairs and/or maintenance

BRIEF DESCRIPTION OF THE DRAWINGS

FIGS. 3*a*–3*c* are flow charts illustrating logic for implementing the centrifuge control of the present invention.

FIGS. 4*a*–4*c* are flow charts illustrating logic for discarding the maximum solids in the centrifuge control logic of FIGS. 3*a*–3*c*.

FIGS. 5*a*–5*c* are flow charts illustrating logic for obtaining the cut point for the centrifuge control logic of FIGS. 3*a*–3*c*.

DESCRIPTION OF THE PREFERRED EMBODIMENT

Figure 1:
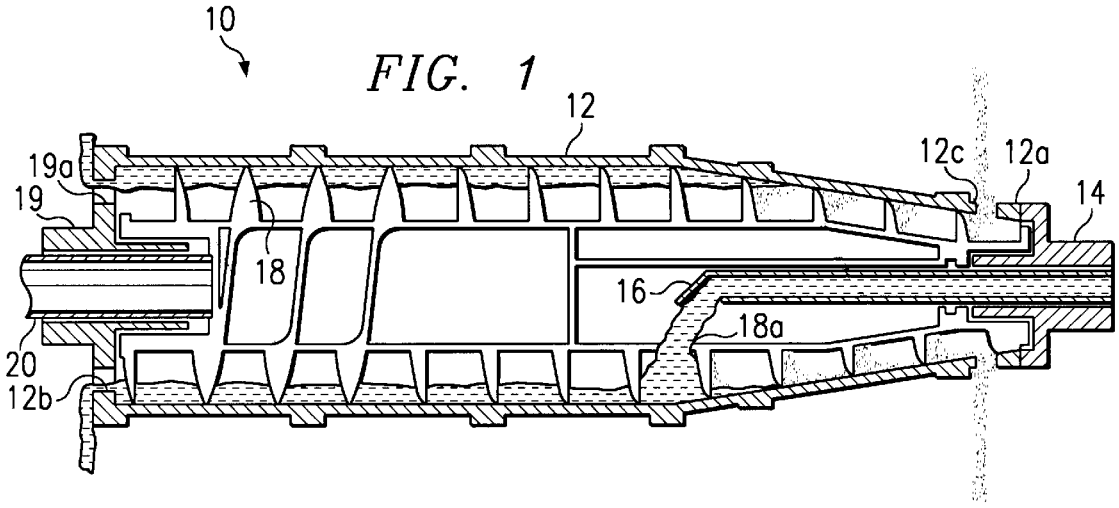
FIG. 1 is a sectional view of a centrifuge which is controlled by the system and method of the present invention.

Referring to FIG. 1 of the drawings, the reference numeral 10 refers in general, to a centrifuge the operation of which is controlled by the system, and according to the method and the computer program of the present invention. The centrifuge 10 includes an elongated bowl 12 supported for rotation about its longitudinal axis. The bowl 12 has two open ends 12*a* and 12*b*, with the open end 12*a* receiving a drive flange 14 which is connected to a drive shaft (not shown in FIG. 1) for rotating the bowl. A longitudinal passage extends through the drive flange 14 for receiving a feed tube 16 for introducing a feed slurry which, for the purposes of example, is a mixture of fluid and disbursed solid particles, into the interior of the bowl 12.

A screw conveyor 18 extends within the bowl 12 in a coaxial relationship thereto and is supported for rotation within the bowl in a manner to be described. To this end, a hollow flanged shaft 19 is disposed in the end 12*b* of the bowl and receives a drive shaft 20 of an external planetary gear box (not shown in FIG. 1) for rotating the screw conveyor 18 in the same direction as the bowl but at a different speed. One or more openings 18*a* extend through the wall of the conveyor 18 near the outlet end of the tube 16 so that the centrifugal forces generated by the rotating bowl 12 causes the slurry to gravitate radially outwardly and pass through the openings 18*a* and into the annular space between the conveyor and the bowl 12. The liquid portion of the slurry is displaced to the end 12*b* of the bowl 12 while the entrained solid particles in the slurry settle towards the inner surface of the bowl due to the G forces generated, and are scraped and displaced by the screw conveyor 18 back towards the end 12*a* of the bowl for discharge through a plurality of discharge ports 12*c* formed through the wall of the bowl 12 near its end 12*a*. A plurality of weirs 19*a* (two of which are shown) are provided through the flanged portion of the shaft 19 for discharging the separated liquid. This type of centrifuge is known in the art and, although not shown in the drawings, it is understood that the centrifuge 10 would be enclosed in a housing or casing, also in a conventional manner.

Figure 2:
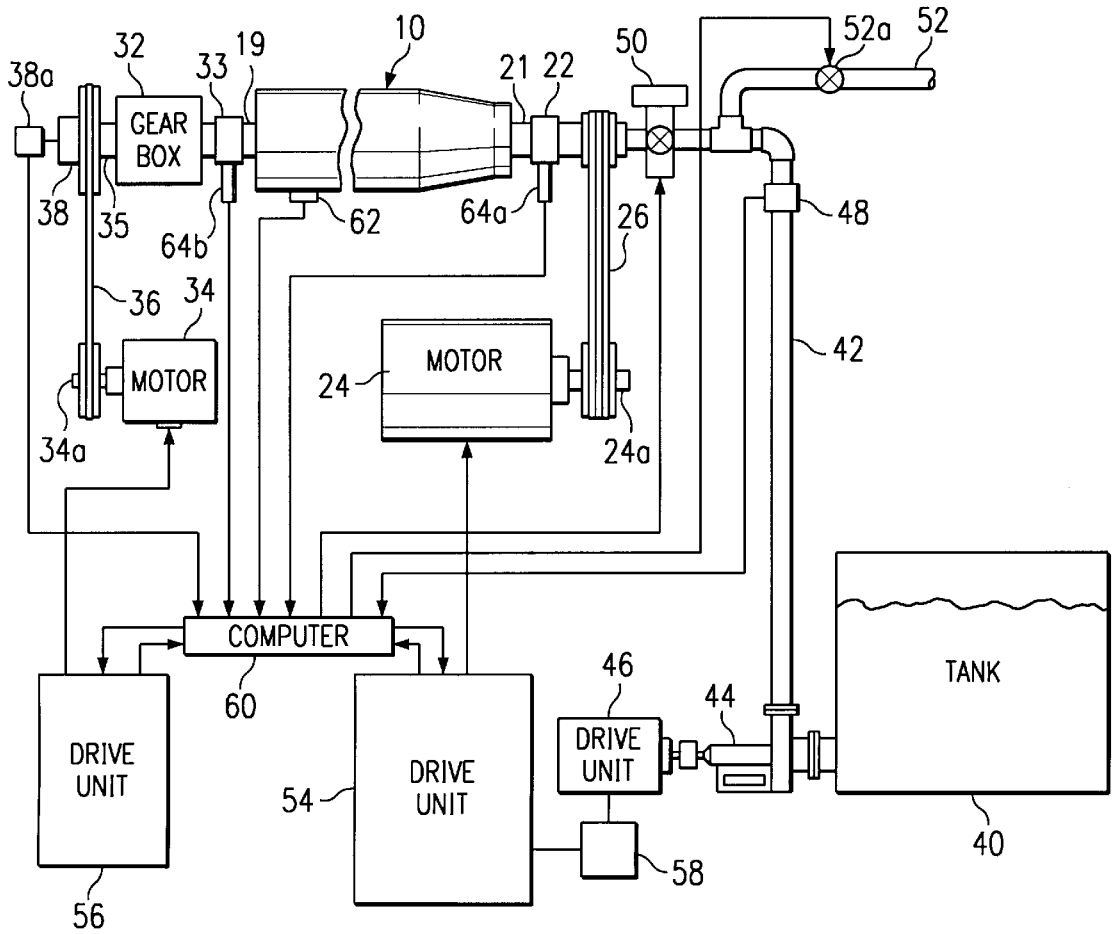
FIG. 2 is a schematic view depicting the centrifuge of FIG. 1 along with its associated components and the control system of the present invention.
Figure 3C:
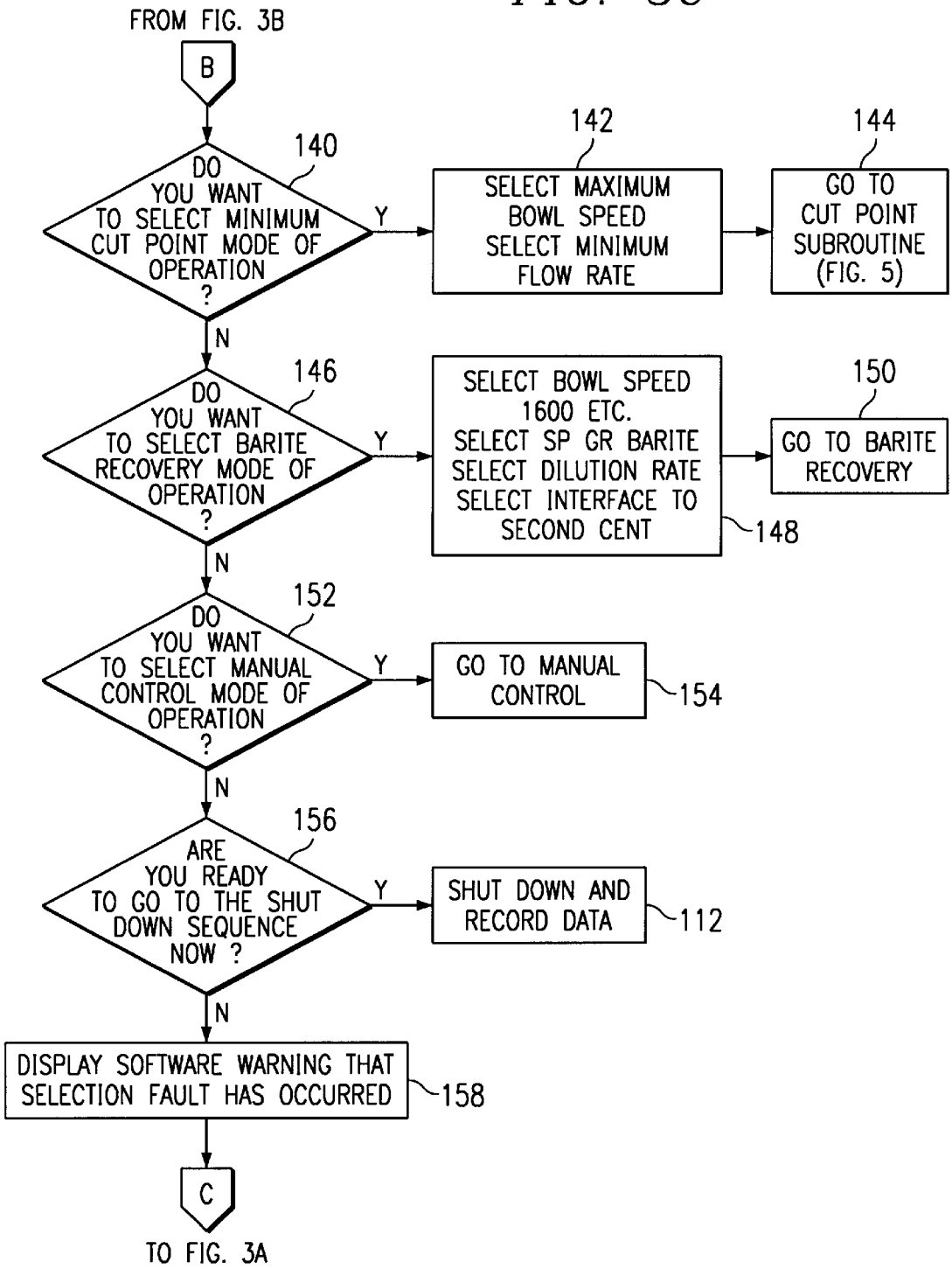

Referring to FIG. 2, a drive shaft 21 forms an extension of, or is connected to, the drive flange 14 (FIG. 1) and is supported by a bearing 22. A variable speed AC main drive motor 24 has an output shaft 24*a* which is connected to the drive shaft 21 by a drive belt 26 and therefore rotates the bowl 12 (FIG. 1) of the centrifuge 10 at a predetermined operational speed.

The flanged shaft 19 extends from the interior of the conveyor 18 to a a planetary gear box 32 and is supported by a bearing 33. A variable speed AC back drive motor 34 has an output shaft 34*a* which is connected to a sun wheel 35 by a drive belt 36 and the sun wheel is connected to the input of the gear box 32. Therefore the motor 34 rotates the screw conveyor 18 (FIG. 1) of the centrifuge 10 through the planetary gear box 32 which functions to establish a differential speed of the conveyor 18 with respect to the bowl 12. A coupling 38 is provided on the shaft of the sun wheel 35, and a limit switch 38*a* is connected to the coupling which functions in a conventional manner to shut off the centrifuge when excessive torque is applied to the gearbox 32.

A tank 40 is provided for receiving and containing the feed slurry being processed, and a conduit 42 connects an outlet opening formed in the lower portion of the tank to the feed tukbe 16. Although not shown in detail in the drawings, it is understood that an internal passage is formed through the shaft 21 which receives the conduit 42 and enables the feed slurry to pass through the conduit and the feed tube 16 and into the conveyor 18. A pump 44 is connected to the conduit 42 and is driven by a drive unit 46, preferably in the form of an electric motor, for pumping the slurry from the tank 40, through the conduit 42 and the feed tube 16, and into the centrifuge 10.

A flow meter 48 is connected to the conduit 42 for metering the slurry flow through the conduit, and a control valve 50 is connected to the conduit downstream of the meter 48 for controlling the flow rate of the slurry. A conduit 52 registers with the conduit 42 for introducing a dilution agent, such as water or diesel, into the conduit under the control of a valve 52*a* disposed in the conduit 52. As a result, the viscosity of the slurry can be reduced so that sedimentation will occur more quickly and the centrifuge 10 can be flushed out when needed.

Two variable speed drive units 54 and 56 are respectively connected to the motors 24 and 34 for driving same at variable frequencies and at variable voltages as dictated by the operational requirements of the system as will be described. A magnetic starter 58 is connected between the drive unit 54 and the motor 46 to receive a control signal from the unit 54 to control the operation of the pump 44. The drive unit 54 is electrically connected to the starter 58 for supplying a control signal to the starter and thus control the operation of the pump 44.

A computer 60 is provided which contains computer programs stored on computer-readable media and containing instructions for controlling the operation of the centrifuge 10. The computer 60 has several input terminals two of which are respectively connected to the drive units 54 and 56 for receiving data from the drive units, and two output terminals for respectively sending control signals to the drive units. The computer 60 thus responds to the input signals received and controls the drive units 54 and 56 in a manner so that the drive units can continuously vary the frequency and the voltage applied to the respective AC motors 24 and 34 accordingly, to continuously vary the rotation and the torque applied to the drive shaft 21 and to the sun wheel 35, respectively, in a manner to be described.

Another input terminal of the computer 60 is connected to the limit switch 38*a* which provides a signal to the computer in response to excessive torque being applied to the gear box 32. Also, an output signal from the flow meter 48 is passed to an additional input terminal of the computer 60 for downloading information to the unit 60 relating to the flow of the slurry through the conduit 42, and an output terminal of the computer 60 is connected to the valve 50 for controlling its operation and therefore the latter flow.

A vibration detector 62 is mounted on the outer surface of the bowl 12 (FIG. 2), is connected to the computer 60, and responds to excessive vibrations of the centrifuge for generating an output signal that causes the computer to send signals to the drive units 54 and 56 to turn off the motors 24 and 34, respectively and therefore shut down the centrifuge 10.

A pair of accelerometer sets 64*a* and 64*b* are connected at or near the bearings 22 and 33, respectively and each set includes two accelerometers for respectively measuring certain operational characteristics of the drive shafts 21 and 20 and their associated bearings. The accelerometer sets 64*a* and 64*b* are connected to the computer 60 for passing their respective output signals to the computer 60 for processing. The accelerometer sets 64*a* and 64*b* can be of the type disclosed in U.S. Pat. No. 4,626,754, the disclosure of which is hereby incorporated by reference. Generally, each accelerometer set includes two or more accelerometers having orthogonal axes that are placed on the frames of the bearings 22 and 33 for detecting vibrations causes by the rotating bowl 12 and screw conveyor 18, as well as the drive shaft 21 and the sun wheel 35. The signals provided by the accelerometers of each set 64*a* and 64*b* are passed to the computer 60 where a computer program contained in the computer analyzes the signals for the presence of specific predetermined frequency signatures corresponding to particular components and their status, which could include a potentially malfunctioning condition. The computer program contained is designed to provide instructions to produce an output in response to any of these frequency signatures being detected, as will be discussed in detail.

Since all of the above-described connections to and from the computer 60 are conventional electrical connections involving conventional electrical conductors and the like, they will not be described in any further detail. Although not shown, the computer 60 comprises conventional devices including, but not limited to, a processor, a main memory, a mass storage device, a video display, an input device, and an audible signal.

In the interest of clarity and to avoid unnecessary repetition, many features associated with the above-described control system of the present invention are described in reference to the hardware components described above, while other features are describe with reference to a program running on the computer 60. Therefore, the description of the hardware components shown in FIGS. 1–2 will make general reference to computer instructions, while the description of the computer instructions illustrated in FIGS. 3*a*–5*c* will make general reference to the hardware components.

Several basic electrical components associated with the above-described control system of the present invention are not shown in the interest of brevity. For example, in field applications, a generator would normally be provided which generates electrical power and passes it to a breaker box which distributes the power to the drive units 54 and 56 and to the motor 46.

In operation, and with reference to FIGS. 1 and 2, the storage tank 40 receives the slurry, which for the purpose of example, will be assumed to be a mixture of fluid and entrained solid particles. The computer 60 sends an appropriate signal, via the drive unit 54, to the starter 58 which functions to start the electric motor 46 and thus activate the pump 44. The slurry is thus pumped through the conduit 42 and into the interior of the bowl 12 in the manner described above.

The motor 24 is activated and controlled by the drive unit 54 to rotate the drive shaft 21, and therefore the bowl 12, at a predetermined speed. The motor 34 is also activated and driven by the drive unit 56 to rotate the sun wheel 35, and therefore the screw conveyor 18, through the planetary gear box 32, in the same direction as the bowl 12 and at a different speed.

As a result of the rotation of the bowl 12, the centrifugal force thus produced forces the slurry radially outwardly so that it passes through the openings 18*a* in the conveyor and into the annular space between the conveyor and the bowl 12. The fluid portion of the slurry is displaced to the end 12*b* of the bowl 12 for discharge from the weirs 19*a* in the flanged shaft 19, while the entrained solid particles in the slurry settle towards the inner surface of the bowl due to the G forces generated, and are scraped and displaced by the screw conveyor 18 back towards the end 12*a* of the bowl for discharge through the discharge ports 12*c*.

The computer 60 receives a signal from the flow meter 48 indicating the flow rate of the slurry entering the centrifuge 10, as well as signals from the drive units 54 and 56 corresponding to torque and speed of the motors 24 and 34, respectively. The computer 60 contains instructions which enables the computer to process the above data and control the drive units 54 and 56, the valve 50, and the dilution valve 52*a* accordingly, based on a predetermined desired operational mode of the centrifuge 10. Thus, the drive units 54 and 56 will vary the frequency and voltage applied to the motors 24 and 34, respectively, as needed to continuously vary the rotational speed of, and the torque applied to, the drive shaft 21 and the sun wheel 35, respectively, as necessary to maintain predetermined optimum operating conditions.

The accelerometer sets 64*a* and 64*b* respond to changes in rotational speed of the drive shaft 21 and the sun wheel 35, and therefore the bowl 12 and the conveyor 18, in terms of frequency, as well as changes in the drive current to the motors 24 and 34 in terms of amplitude which corresponds to load, and generate audible beats corresponding to frequency changes that occur as the loading on the bowl and the conveyor change. These audible beats are processed by the computer 60 and enable the above-mentioned predetermined optimum operating conditions to be attained in a relatively quick manner. More particularly, the loading and unloading of the conveyor 18 caused by the deposition rate of the solids in the bowl 12 and the differential speed of the conveyor 18 cause sonic frequency patterns, or beats. The accelerometers 64*a* and 64*b* will detect these beats and signal the computer 60 which will access this data and compare it to known beats patterns. This will enable the computer 60 to increase or decrease the load on the conveyor 18 without solely relying on the torque of the motor 34 as sensed by the drive unit 56. This type of data interpretation will effect a quicker convergence to proper conveyor loading and would use motor torque in a check and balance convention.

The computer 60 also receives signals from the accelerometer sets 64*a* and 64*b* corresponding to the vibrations generated by the rotating bowl 12 and conveyor 18, as well as their respective drive shafts 21 and 20. The computer 60 processes this information to determine if any anomalies are present causing the vibrations and, if so, the computer generates output signals to adjust the operation of the drive units 54 and 56, the starter 58, and/or the valves 50 and 52*a* accordingly to reduce, if not eliminate, the vibrations. In this context, the computer 60 generates a warning signal indicating the possibility of a malfunction or failure. In addition, if the vibrations are in excess of a predetermined amount, the vibration detector 62 will send an appropriate signal to the computer 60 which, in turn will shut down the centrifuge 10.

In the event the centrifuge 10 become jammed for whatever reason the computer 60 will receive corresponding input signals from the drive units 54 and/or 56 and will send a signal to the starter 58 to turn off the pump 44 and thus cease the flow of the feed slurry to the centrifuge.

The computer 60 also monitors the torque applied to the sun wheel 35 from data received from the drive unit 56 and maintains the torque at a relatively high percentage, such as 85%, of the limit of the coupling 38. To this end, in the event one of the above inputs to the computer 60 changes, the computer contains instructions to enable it to change one or more of its output signals to the drive units 54 and 56, the valve 50, the starter 58, or the dilution valve 53*a* to change their operation accordingly. For example, if the screw conveyor 18 (FIG. 1) becomes worn and/or the pump 44, for whatever reason, will not deliver its maximum pumping rate, the computer will compensate by sending the proper signal to the drive unit 54 to increase the speed of the bowl 12 and/or to the drive unit 56 to increase the speed of the conveyor 18. In this context, it can be appreciated that changes in the viscosity of, and particle size distribution in, the slurry will be accommodated by attendant changes in the output control to the motors 24 and 34 and to the flow control valve 50 without the need for identifying the particular fluid property changes.

Another feature of the present invention includes the ability to change the operation of the centrifuge in accordance with particular requirements. For example, the computer 60 contains instructions to enable the computer to operate the centrifuge 10 in two distinct operating modes such as, for example, a mode in which maximum solids volume separation is attained, or a mode in which the maximum number of the solid particles from the liquid in the slurry being processed is separated, based on the weight of the separated solids. Of course, the particular operational mode desired is user-selected at the computer 60 and, in either case, the computer would produce output signals that respectively control the drive units 54 and 56, the valve 50, and/or the valve 52*a* accordingly, and, if necessary, turn off the pump 44 via the starter 58.

FIGS. 3*a*–3*c*, 4*a*–4*c* and 5*a*–5*c* are flowcharts illustrating logic of a computer program 100 that operates on the computer 60 to implement features of the present invention. It is understood that the computer program 100 is written in a conventional programming language and is not restricted to any one computer hardware or software platform. Furthermore, it is understood that certain logic features of the program 100 may alternatively be implemented by discrete mechanical or electrical components. Therefore, the computer program 100 is described in functional terms so that one of ordinary skill in the art may readily adapt it to computer program instructions in a desired format.

Referring to FIGS. 2 and 3*a*–3*c*, execution begins at step 102 with a call to the computer program 100 from a supervisory application program (not shown) being executed on the computer 60 for the purpose of controlling the operation of the centrifuge 10. At step 104, the inputs from the drive units 54, 56, the flow meter 48, the accelerometer sets 64*a*, 64*b*, the vibration detector 62 and the limit switch 38*a*, referenced generally as "the sensors," are checked. Also, the high and low limits for the speeds of the two motors 24, 34, are established, the control valve 50 is set to an initial position, and the control valve 52*a* is turned off. The program 100 then starts a new recording file, and initializes each increment of adjustment, or "set", to a predetermined value. At step 106, the sets for modifying the speed of the drive motors 24, 34 and controlling the valves 50, 52*a* are adjusted. Also, the initial dilution, safety and shut down limits, and the vibration detector 62 limits are set. In addition, the torque and current limits for the main drive motor 24 and back drive motor 34 are set, as is the speed of the bowl 12. Finally, an automatic self check procedure checks for faults and errors in the various components. The torque and current of the motors 24 and 34 are monitored through the drive units 54 and 56, respectively. The speed of the bowl 12 is monitored and controlled through the main drive 24 and the drive unit 54.

At step 108, a determination is made for starting the centrifuge 10 in either a manual or an automatic mode. If starting in manual mode, execution proceeds to step 110, where a determination is made whether to continue readout and memory storage in the computer 60 of data from the sensors. If a determination is made not to continue the readout and memory storage of the data, execution proceeds to step 112, which calls a procedure to shut down the automatic control of the centrifuge 10 and write all the data to the memory. If in step 110 a determination is made to continue reading the sensor and storing the data to memory, execution proceeds to step 114, which calls a procedure to store and display the data. Execution then returns to step 108, thereby repeatedly prompting whether to continue in the manual mode or enter the automatic mode.

If at step 108, a determination is made to start the centrifuge 10 in the automatic mode, execution proceeds to step 116. At step 116, a determination is made if any faults or errors were found. If so, execution proceeds to step 118, which sounds the warning signal and displays error messages, along with possible solutions or causes. Execution then returns to step 106. If at step 116 faults or errors were not found, execution proceeds to step 120.

At step 120, the computer 60 begins additional processes, including starting all the sensors to send the data, sampling the data, recording the data to memory, turning off the accelerometer sets 64*a*, 64*b* and starting the back drive motor 34 through the drive unit 56. At step 122, a determination is made if a current drawn by back drive motor 34 is within limits. If the back drive motor current is not within limits, execution proceeds to step 124 which sounds the warning signal and displays messages that a mechanical error has occurred, such as the conveyor 18 is frozen or the centrifuge 10 is packed off. Execution then proceeds to step 112, which shuts down the automatic control of the centrifuge 10 and writes all the data to memory.

If in step 122 the current is within the limits, execution proceeds to step 126. At step 126, the main drive motor 24 is started through drive unit 54. The speed of the main drive motor 24 is ramped up to an initial speed. At step 128, a decision is made if the current drawn by the main drive motor 24 is within limits. If the main drive motor current is not within the limits, execution proceeds to step 130 which sounds the warning signal and displays messages that a mechanical error has occurred, such as the bowl 12 is frozen, the bowl is full of mud, or the main drive motor 24 is drawing too much current. Execution then proceeds to step 112, which shuts down the automatic control of the centrifuge 10 and writes all the data to memory.

If in step 128 the main drive motor current is within the limits, execution proceeds to step 132. At step 132, the control valve 50 is opened to an initial setting. At step 134, the feed pump 44 is started and the rate of flow through the conduit is checked with the flow meter 48. At step 136, a determination is made if a mode for discarding the maximum amount of solids should begin. If the determination is to enter the mode for discarding the maximum amount of solids, execution proceeds to step 138, which calls a MAXIMUM SOLIDS DISCARD subroutine, discussed in greater detail with reference to FIGS. 4*a*–4*c*.

If in step 136, the decision is not to enter the mode for discarding the maximum amount of solids, execution proceeds to step 140. At step 140, a determination is made whether to enter a mode for setting the minimum size of solids to be separated, hereinafter "cut point." If the determination is to enter the cut point mode, execution proceeds to step 142, which performs a series of processes, including selecting a maximum speed for the main drive motor 24 and selecting a minimum level for the flow rate through the flow meter 48. Execution then proceeds to step 144, which calls a CUT POINT subroutine, discussed in greater detail with reference to FIGS. 5*a*–5*c*.

If in step 140, the determination is not to enter the cut point mode, execution proceeds to step 146. At step 146, a determination is made whether to enter a mode for recovering barite. If the determination is to enter the mode for recovering barite, execution proceeds to step 148, which performs a series of processes, including setting the speed for the main drive motor 24, selecting a particle size distribution for the barite, setting a dilution rate and selecting an interface for the barite. Execution then proceeds to step 150, which calls a BARITE RECOVERY subroutine. The BARITE RECOVERY subroutine is used to maximize the distribution of the particle size being removed. After reviewing the logic diagram for the CUT POINT subroutine of FIGS. 5*a*–5*c*, it would be clear to one of ordinary skill in the art, in possession of the present disclosure, how to modify the CUT POINT subroutine to perform the functions of the BARITE RECOVERY subroutine. Therefore, for the sake of brevity, the BARITE RECOVERY subroutine will not be further discussed.

If in step 146, the determination is not to enter the mode for recovering barite, execution proceeds to step 152. At step 152, a determination is made whether to enter manual mode. If the determination is to enter manual mode, execution proceeds to step 154, wherein the computer 60 no longer makes changes to the speed for the main drive motor 24, the back drive motor 34, or the flow rates.

If in step 152, the determination is not to enter the manual mode, execution proceeds to step 156. At step 156, a determination is made whether to shut down. If the determination is made to shut down, execution proceeds to step 112, which shuts down the automatic control of the centrifuge 10 and writes all the data to memory.

If in step 156, the determination is made to not shut down, execution proceeds to step 158, which sounds the warning signal and displays a message that a selection fault has occurred. Execution then loops back to step 104 and repeats the entire operation.

Figure 4B:
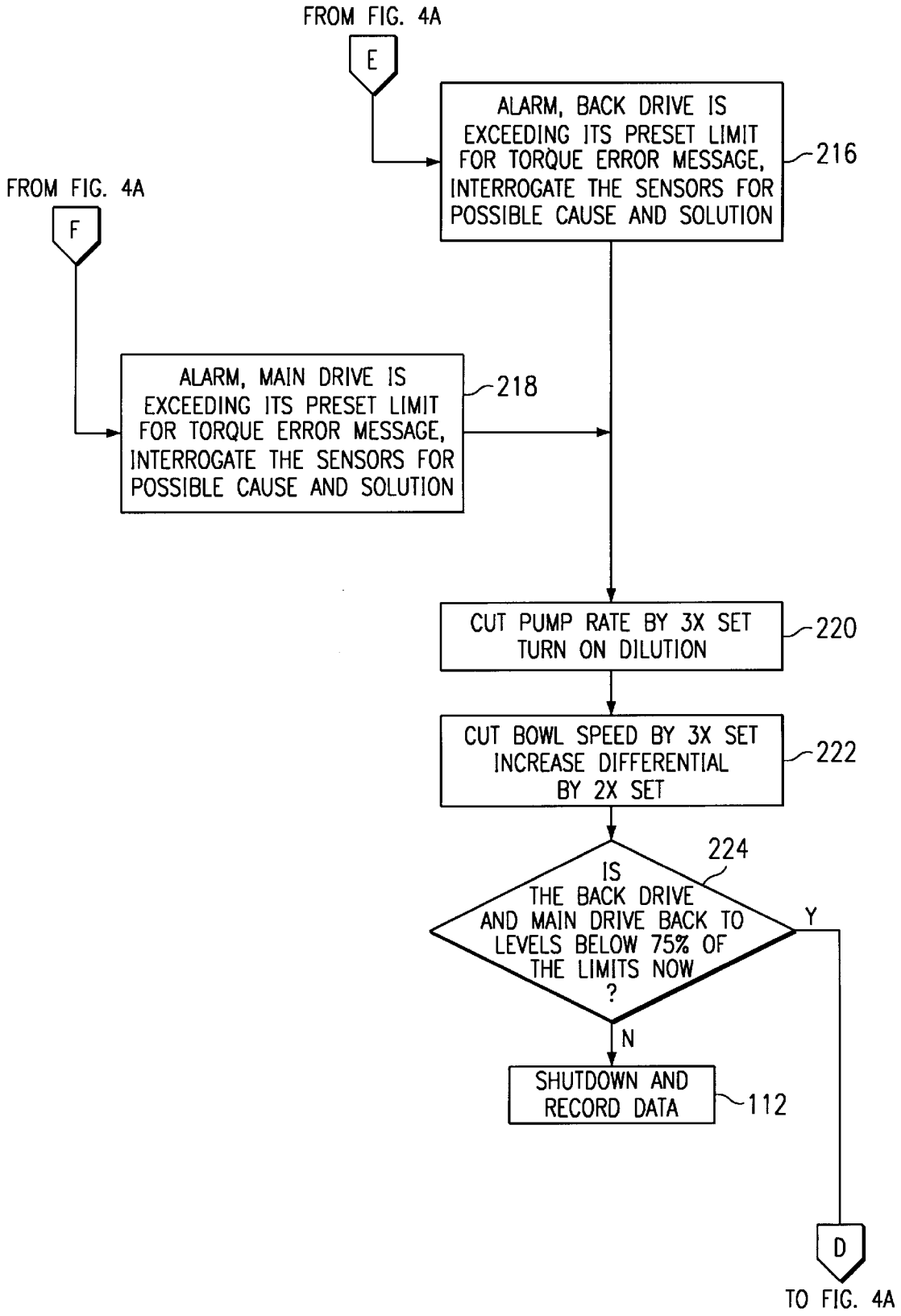
Figure 4C:
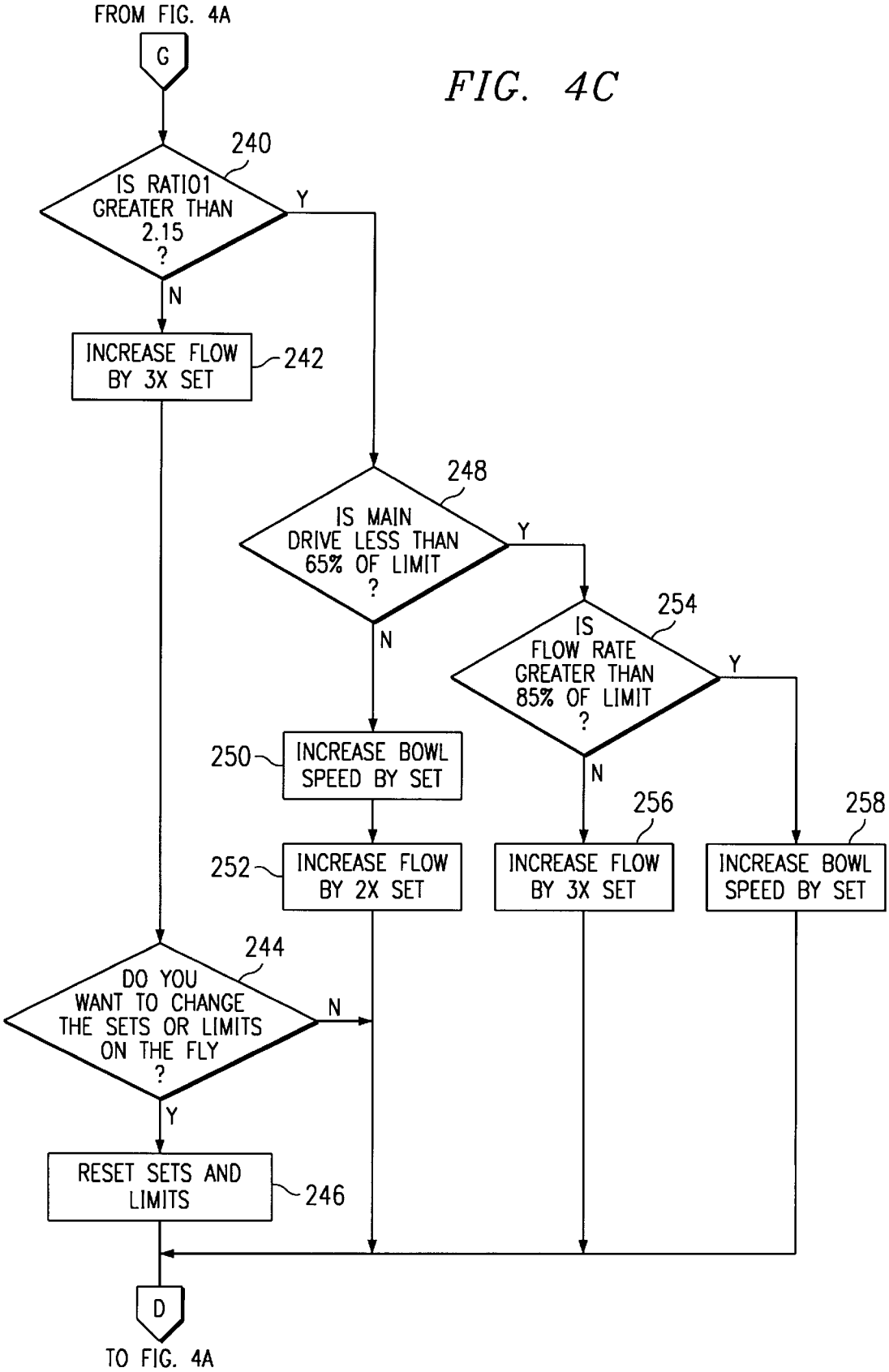

Referring also to FIGS. 4*a*–4*c*, the subroutine MAXIMUM SOLIDS DISCARD, which is called by step 135 of the computer program 100, begins execution at step 200. At step 202, a comparison is made to determine whether the current drawn by the back drive motor 34 is within 75% of its limit. If the back drive motor 34 current is over 75% of its limit, execution proceeds to step 204, where a determination is made whether the back drive motor current is over 85% of its limit. If the back drive motor 34 current is not over 85% of its limit, execution proceeds to step 206, which reduces the speed of the back driver motor so that the differential between the speed of the two motors 24 and 34 is increased by one set. Execution then loops back to step 202.

As referred to herein, the term "set" refers to a change increment for the particular type of equipment to which it is applied. In the context of the preferred embodiment, the change increments are (1) a bowl 12 speed change increment such as 10 rpm; (2) a back drive motor 34 speed change increment such as 5 rpm; (3) a valve 50 opening change such as 1% of range; (4) a main drive motor 24 current change increment such as 0.5 amp; and (5) a back drive motor 34 current change increment such as 0.1 amp.

If in step 202, a determination is made that the back drive motor 34 current is below 75% of its limit, execution proceeds to step 208. At step 208, a comparison is made to determine whether the current drawn by the main drive motor 24 is within 75% of its limit. If the main drive motor 24 current is over 75% of its limit, execution proceeds to step 210, where a determination is made whether the main drive motor current is over 85% of its limit. If the main drive motor 24 current is not over 85% of its limit, execution proceeds to step 214, which reduces the speed main driver motor 24, and thus the speed of the bowl 12, by two sets. Execution then loops back to step 202.

If in step 204 a determination is made that the back drive motor 34 current is over 85% of its limit, execution proceeds to step 216 which sounds the warning signal and displays a message stating that the back drive motor has a current limit or torque error. Also in step 216, the computer 60 interrogates the sensors for a possible cause of the problem. If in step 208 a determination is made that the main drive motor 24 current is over 85% of its limit, execution proceeds to step 218 which sounds the warning signal and displays a message stating that the main drive motor has a current limit or torque error. Also in step 218, the computer 60 interrogates the sensors for a possible cause of the problem. Upon completion of either step 218 or 216, execution proceeds to step 220, which reduces the rate for the pump 44 by three sets and opens the control valve 52*a* to begin dilution. At step 222, the speed of the main drive motor 24, and thus the speed of the bowl 12, is reduced by three sets, thereby increasing the differential between the two motors 24 and 34. At step 224, a determination is made if both the main drive motor 24 and back drive motor 34 are running below their 75% limits. If both the motors 24, 34 are running below their limit, execution loops back to step 202. If either of the drives 24 or 34 is running above its respective limit, execution proceeds to step 112, which shuts down the automatic control of the centrifuge 10 and writes all the data to memory.

If at step 208 a determination is made that the main drive motor 24 is running at or below 75% of its preset limit, execution proceeds to step 226. At step 226, the computer 60 calculates and records a ratio ("RATIO1") of the current drawn by the main drive motor 24 verses the current drawn by the back drive motor 34. At step 228 a determination is made if the beats produced by the accelerometer sets 64*a* and 64*b* have a frequency greater than one cycle every three seconds. If the beat frequency is greater than one cycle every three seconds, execution proceeds to step 230, which reduces the speed of the back drive motor 34 by one set. Execution then loops back to step 202.

If in step 228 a determination is made that the beat frequency is less than one cycle every three seconds, execution proceeds to step 232. In step 232, the RATIO1 is compared with a value 3.57. If the RATIO1 is greater than the value 3.57, execution proceeds to step 234. At step 234, the flow rate measured by the flow meter 48 is compared with a value 30 gallons per minute ("G.P.M."). If the flow rate is greater than 30 G.P.M., execution proceeds to step 236, which increases the flow rate one set by opening the control valve 52. If the flow rate is less than 30 G.P.M., execution proceeds to step 238, which changes the speed of the back drive motor 34 to reduce the differential between the two motors 24 and 34. Upon completion of steps 238 or 236, execution then loops back to step 202.

If in step 232 the RATIO1 is less than the value 3.57, execution proceeds to step 240. In step 240, the RATIO1 is compared with a value 2.15. If the RATIO1 is less than the value 2.15, execution proceeds to step 242. At step 242, the flow rate is increased three sets by opening the control valve 52. At step 244, a determination is made if the sets or limits should be changed. If not, execution loops back to step 202. If in step 244 the sets or limits should be changed, execution proceeds to step 246, which resets the sets and limits. Execution then loops back to step 202.

If in step 240 the RATIO1 is determined to be greater than the value 2.15, execution proceeds to step 248. At step 248, a determination is made if the speed of the main drive motor 24 is less than 65% of its limit. If not, execution proceeds to step 250, which increases the speed of the main motor 24 by one set, thereby increasing the speed of the bowl 12. At step 252, the control valve 52 is adjusted to increases the flow rate by two sets. Execution then loops back to step 202.

If in step 248 the speed of the main drive motor 24 is greater than 65%, execution proceeds to step 254. At step 254, a determination is made if the flow rate through the flow meter 48 is greater than 85% of its limit. If not, execution proceeds to step 256, which adjusts the control valve 52 to increase the flow rate by three sets. Execution then loops back to step 202. If in step 254 the flow rate through the flow meter 48 is greater than 85% of its limit, execution proceeds to step 258, which increases the speed of the main motor 24 by one set, thereby increasing the speed of the bowl 12. Execution then loops back to step 202.

Figure 5B:
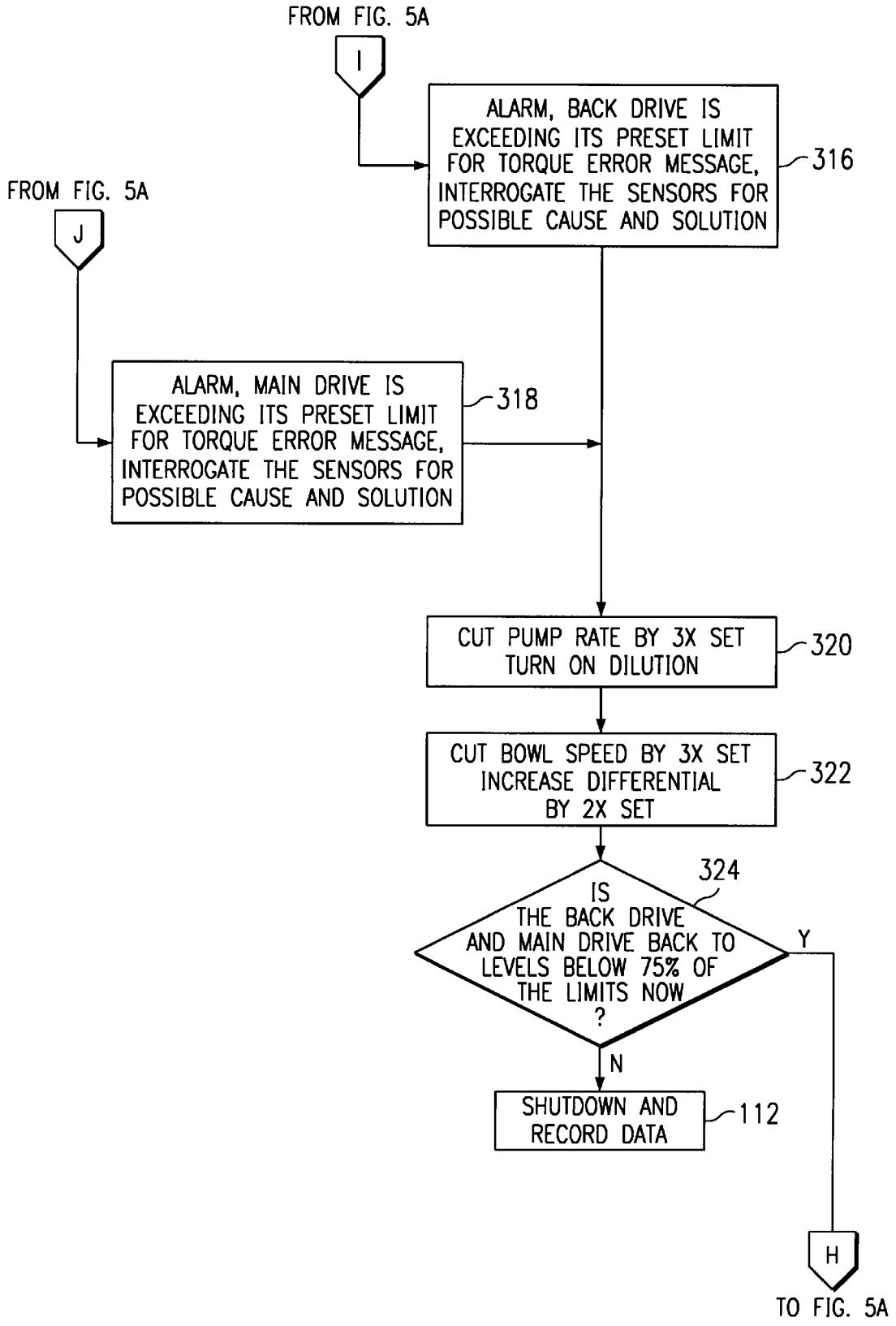
Figure 5C:
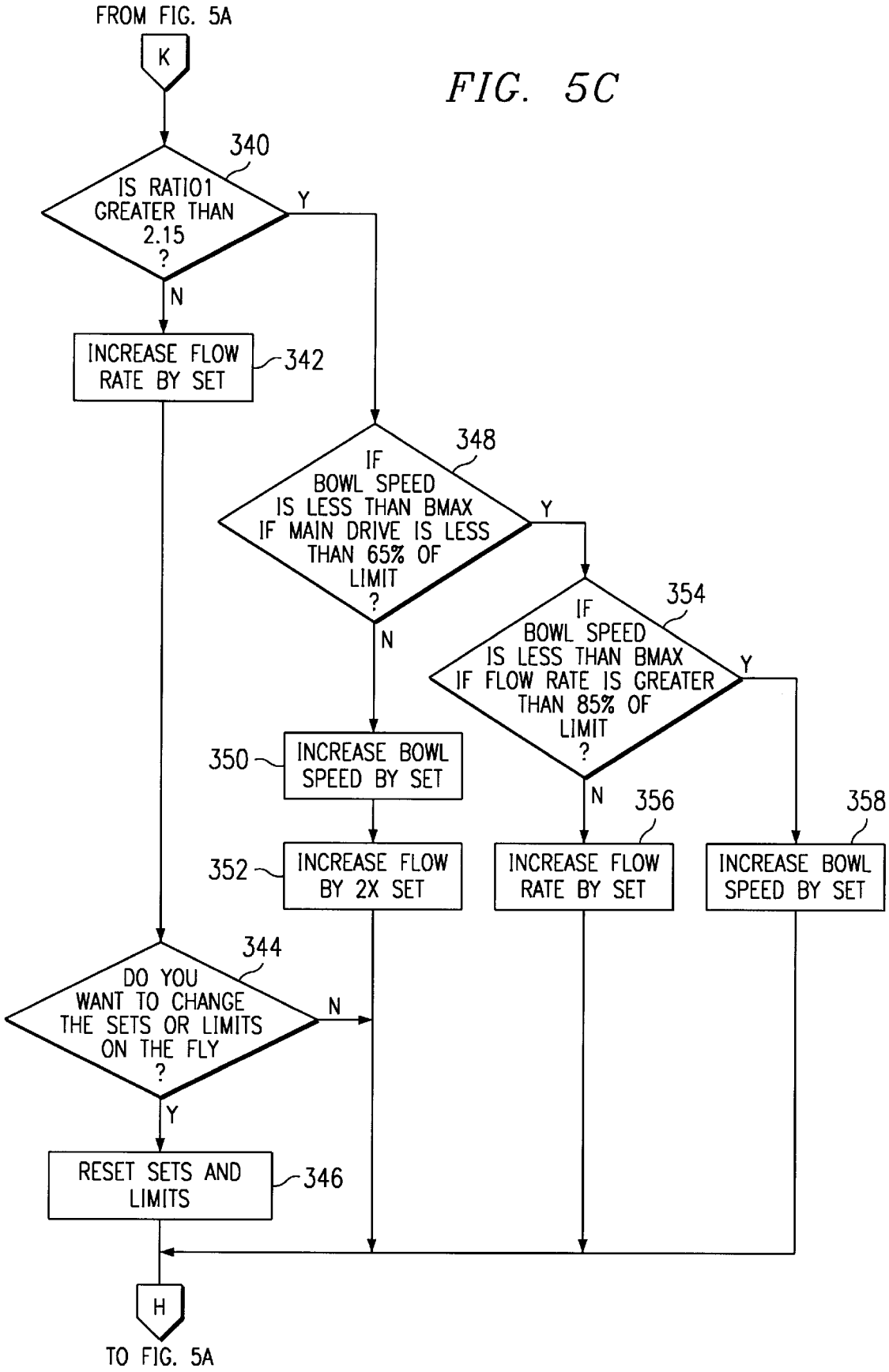

Referring to FIGS. 5*a*–5*c*, the subroutine CUT POINT, which is called at step 144 (FIG. 3C) of the computer program 100, begins execution at step 300. At step 302, a comparison is made to determine whether the current drawn by the back drive motor 34 is within 75% of its limit. If the back drive motor current is over 75% of its limit, execution proceeds to step 304, where a determination is made whether the back drive motor current is over 85% of its limit. If the back drive motor current is not over 85% of its limit, execution proceeds to step 306, which reduces the speed of the back driver motor so that the differential between the speeds of the two motors 24 and 34 is increased by one set. Execution then loops back to step 302.

If in step 302, a determination is made that the back drive motor current is below 75% of its limit, execution proceeds to step 308. At step 308, a comparison is made to determine whether the current drawn by the main drive motor 24 is within 75% of its limit. If the main drive motor current is over 75% of its limit, execution proceeds to step 310, where a determination is made whether the main drive motor current is over 85% of its limit. If the main drive motor current is not over 85% of its limit, execution proceeds to step 314, which reduces the main driver motor speed and thus the speed of the bowl 12, by two sets. Execution then loops back to step 302.

If in step 304 a determination is made that the back drive motor current is over 85% of its limit, execution proceeds to step 316 which sounds the warning signal and displays a message stating that the back drive motor is exceeding its preset limit. Also in step 316, the computer 60 interrogates the sensors for a possible cause of the problem. If in step 308 a determination is made that the main drive motor current is over 85% of its limit, execution proceeds to step 318 which sounds the warning signal and displays a message stating that the main drive motor is exceeding its preset limit. Also in step 318, the computer 60 interrogates the sensors for a possible cause of the problem. Upon completion of either step 318 or 316, execution proceeds to step 320, which reduces the rate for the pump 44 by three sets and opens the control valve 52a to begin dilution. At step 322, the speed of the main drive motor 24, and thus the speed of the bowl 12, is reduced by three sets, thereby increasing the differential between the two motors 24 and 34. At step 324, a determination is made if both the main drive motor current and back drive motor current are below their respective 75% limits. If both the currents are below their respective limits, execution loops back to step 302. If either the main drive motor current or the back drive motor current is above its respective limit, execution proceeds to step 112, which shuts down the automatic control of the centrifuge 10 and writes all the data to memory.

If at step 308 a determination is made that the main drive motor current is below 75% of its preset limit, execution proceeds to step 326. At step 326, the computer 60 calculates and records a ratio ("RATIO1") of the main drive motor current verses the back drive motor current. At step 328 a determination is made if the beats produced by the accelerometer sets 64*a* and 64*b* have a frequency greater than one cycle every three seconds. If the beat frequency is greater than one cycle every three seconds, execution proceeds to step 330, which reduces the speed of the back drive motor 34 by one set. At step 330*a*, the speed of the main drive motor 24 is increased by two sets, thereby increasing the speed of the bowl 12. Execution then loops back to step 302.

If in step 328 a determination is made that the beat frequency is less than one cycle every three seconds, execution proceeds to step 331. In step 331, the speed of the main drive motor 24 and the bowl 12 is compared to a predetermined maximum bowl speed. If the speed of the main drive motor 24 and the bowl 12 equals the maximum bowl speed, execution proceeds to step 331*a*, which sets a flag BOWL SPEED equal to a value BMAX. Upon completion of step 331*a*, or if in step 331 the bowl speed does not equal the maximum bowl speed, execution proceeds to step 332.

In step 332, the RATIO1 is compared with the value 3.57. If the RATIO1 is greater than the value 3.57, execution proceeds to step 334. At step 334, the flow rate measured by the flow meter 48 is compared with the value 30 G.P.M. If the flow rate is greater than 30 G.P.M., execution proceeds to step 336, which increases the flow rate one set by opening the control valve 52. If the flow rate is less than 30 G.P.M., execution proceeds to step 338, which changes the speed of the back drive motor 34 to reduce the differential between the two motors 24 and 34. Upon completion of steps 238 or 236, execution then loops back to step 302.

If in step 332 the RATIO1 is less than the value 3.57, execution proceeds to step 340. In step 340, the RATIO1 is compared with a value 2.15. If the RATIO1 is less than the value 2.15, execution proceeds to step 342. At step 342, the flow rate is increased one set by opening the control valve 52. At step 344, a determination is made if the sets or limits should be changed. If not, execution loops back to step 302. If in step 344 the sets or limits should be changed, execution proceeds to step 346, which resets the sets and limits. Execution then loops back to step 302.

If in step 340 the RATIO1 is determined to be greater than the value 2.15, execution proceeds to step 348. At step 348, a determination is made if the speed of the main drive motor 24 and the bowl 12 is less than the value BMAX and the current drawn by the main drive 24 is less than 65% of its limit. If either the speed of the main drive motor 24 and the bowl 12 equals the value BMAX or the current drawn by the main drive 24 is greater than 65% of its limit, execution proceeds to step 350, which increases the speed of the main motor 24 by one set, thereby increasing the speed of the bowl 12. At step 352, the control valve 52 is adjusted to increases the flow rate by two sets. Execution then loops back to step 302.

If in step 348 the speed of the main drive motor 24 and the bowl 12 is less than the value BMAX and if the current drawn by the main drive 24 is less than 65% of its limit, execution proceeds to step 354. At step 354, a determination is made if the speed of the main drive motor 24 and the bowl 12 is less than the value BMAX and the flow rate through the flow meter 48 is greater than 85% of its limit. If the speed of the main drive motor 24 and the bowl 12 equals the value BMAX or if the flow rate through the flow meter 48 is less than 85% of its limit, execution proceeds to step 356, which adjusts the control valve 52 to increase the flow rate by three sets. Execution then loops back to step 302. If in step 354 the speed of the main drive motor 24 and the bowl 12 is less the value BMAX and the flow rate through the flow meter 48 is greater than 85% of its limit, execution proceeds to step 358, which increases the speed of the main motor 24 by one set, thereby increasing the speed of the bowl 12. Execution then loops back to step 302.

The control system and method of the present invention thus enjoys several advantages. For example, the control system of the present invention can maintain precise predetermined operational modes despite variations in the various operational parameters and design goals. Also, the efficiency of the centrifuge 10 is increased while eliminating pack off and overfeed conditions, regardless of the kind of solids being separated from the fluid. Further, the system and method of the present invention can optimize solids separation regardless of particle size distribution for a given feed rate. Still further, the information received from the accelerometer sets 64*a* and 64*b* can be used to provide both control information to optimize the operation of the centrifuge 10 in a relatively quick manner, as well as preventative maintenance information which will extend operational life and avoid catastrophic failures.

It is understood that the stored memory of the computer 60 can be utilized to provide complete histories of the above-mentioned operational parameters so that the operation of the centrifuge 10 and its associated components may be carefully evaluated. These parameters could include, but not be limited to, the total flow rate processed for a given period, exact operational data corresponding to exact times, accurate estimates of solids discarded and dilution rates. Also, operational maintenance information can be recorded to show how often, and to what extent repairs, lubrication, service, or adjustments were make. The memory of the unit 60 can also be utilized to store a complete troubleshooting, service, and repair guide with all replacement parts.

It is understood that the present invention is not limited to processing the slurry described above in connection with an oil field drilling operation. For example, it is equally applicable to the treatment of pulp, paper, waste water, mining separation, and food processing.

It is understood that other modifications, changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A control system for a centrifuge that receives a mixture of liquid and solid particles and separates the liquid from the solid particles, the centrifuge including a rotatable bowl and a rotatable screw conveyor extending in the bowl; the control system comprising two drive assemblies for respectively rotating the bowl and the conveyor; a flow meter for metering the flow of the mixture to the centrifuge; a valve for controlling the flow of the mixture to the centrifuge; and a computer comprising input terminals connected to the drive assemblies for receiving signals from the drive assemblies corresponding to the speed and torque of the bowl and the conveyor, respectively, an input terminal connected to the meter for receiving signals corresponding to the flow of the mixture, and output terminals connected to the drive assemblies and the valve, the computer being adapted to respond to input signals received from the drive assemblies and the meter and generate output signals to control the drive assemblies and the valve in a manner corresponding to predetermined operating conditions of the centrifuge.

2. The system of claim 1 further comprising a starter for starting and stopping the flow of the mixture to the centrifuge, a conduit for adding a diluting agent to the mixture before it enters the centrifuge, and a valve for controlling the flow of the agent through the conduit; the computer also being adapted to respond to generate output signals that control the operation of the starter and the latter valve.

3. The system of claim 1 wherein the computer is adapted to generate different output signals in response to changes in the predetermined operating conditions of the centrifuge.

4. The system of claim 3 wherein the drive assemblies comprise variable frequency AC motors respectively connected to the bowl and the conveyor for rotating same, and two drive units respectively connected to the AC motors and to the input and the output terminals of the computer for responding to signals received from the computer and varying the frequency and the voltage applied to their respective motors accordingly to continuously vary the speed of, and the torque applied to, the bowl and the conveyor, respectively as necessary to maintain the predetermined operating conditions.

5. The system of claim 1 wherein the drive assemblies provide signals corresponding to the rotational characteristics of, and the load on, the bowl and the conveyor, the computer being adapted to respond to the latter signals.

6. The system of claim 5 wherein the computer responds to the input signals received from the sensors and generates output signals that control one or more of the drive assemblies and the valves to attain the predetermined operating conditions in a relative short time when compared to the time required if fewer signals were received from the sensors.

7. The system of claim 5 wherein the sensors also sense vibrations generated by the rotating bowl and the rotating conveyor and wherein the computer responds to the sensors and controls one or more of the speed of the bowl and the conveyor, the starting and the flow of the mixture, and the adding of the dilution agent accordingly to reduce the vibrations.

8. The system of claim 1 further comprising a detector mounted on the bowl for sensing any vibrations of the bowl and the conveyor in excess of a predetermined amount and for sending a corresponding signal to the computer, the computer sending a corresponding signal to the drive assemblies for terminating the rotation of the bowl and the conveyor.

9. The system of claim 1 further comprising a gearbox connected to the conveyor and a limit switch connected to the gearbox and to the computer for responding to the torque applied to the conveyor and for generating a corresponding output signal corresponding to the torque applied to the conveyor so that the computer responds to the latter signal and terminates the rotation of the conveyer when the torque exceeds a predetermined value.

* * * * *